US008023870B2

(12) United States Patent
Suzuki et al.

(10) Patent No.: US 8,023,870 B2
(45) Date of Patent: Sep. 20, 2011

(54) IMAGE FORMING APPARATUS HAVING A CONTROL SECTION WHICH CORRECTS DEVIATION OF A BELT

(75) Inventors: Chikatsu Suzuki, Hachioji (JP); Kenji Taki, Fuchu (JP); Fusako Ozawa, Hachioji (JP); Yusuke Yamamoto, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 299 days.

(21) Appl. No.: 12/335,757

(22) Filed: Dec. 16, 2008

(65) Prior Publication Data

US 2009/0169274 A1 Jul. 2, 2009

(30) Foreign Application Priority Data

Dec. 26, 2007 (JP) ..... 2007-335203

(51) Int. Cl.
*G03G 15/16* (2006.01)

(52) U.S. Cl. ..... 399/297; 399/302

(58) Field of Classification Search ..... 399/297, 399/302, 303

See application file for complete search history.

(56) References Cited

U.S. PATENT DOCUMENTS 5,479,241 A * 12/1995 Hou et al. ..... 399/75
7,686,158 B2 * 3/2010 Tao et al. ..... 198/807

FOREIGN PATENT DOCUMENTS

JP 57-139775 A 8/1982
JP 07-041201 2/1995
JP 9-048533 A 2/1997
JP 09-169449 6/1997

OTHER PUBLICATIONS

Notice of Reasons for Refusal issued in the corresponding Japanese Patent Application No. 2007-335203 dated Feb. 2, 2010, and an English Translation thereof.

* cited by examiner

*Primary Examiner* — David Gray
*Assistant Examiner* — Barnabas T Fekete
(74) *Attorney, Agent, or Firm* — Buchanan Ingersoll & Rooney PC

(57) ABSTRACT

An image forming apparatus includes: a rotating belt which rotates around a roller; a drive section which rotates the belt; a detection section which detects a position of the belt in a width direction; a moving section which moves the belt in the width direction; a control section which corrects a deviation of the belt by controlling the moving section. The control section conducts a preparatory operation in which the control section changes an amount of control to be given to the moving section under the condition where the belt is rotated to obtain a correction data showing a relation between the amount of control and a change of a position of the belt in the width direction detected by the detection section, stores the correction data in a memory section, and then corrects the deviation based on the correction data stored in the memory section.

7 Claims, 11 Drawing Sheets

FIG. 5

70

| BELT POSITION | FRONT LARGE | FRONT SMALL | CENTRAL | REAR SMALL | REAR LARGE |
|---|---|---|---|---|---|
| DEVIATION CORRECTION SPEED (mm/sec) WHEN ADJUSTMENT ROLLER IS PRESSED | 1.0 | 0.5 | 0 | -0.5 | -1.0 |
| DEVIATION CORRECTION SPEED (mm/sec) WHEN ADJUSTMENT ROLLER IS RELEASED | 2.0 | 1.0 | 0 | -1.0 | -2.0 |

+ REPESENTS REARWARD
- REPRESENTS FRONTWARD

FIG. 7

80

| STEERING AMOUNT | -2° | -1° | 0° | +1° | +2° |
|---|---|---|---|---|---|
| MOVING SPEED (mm/sec) WHEN ADJUSTMENT ROLLER IS PRESSED | -2.1 | -1.1 | 0.2 | 1.0 | 2.0 |
| MOVING SPEED (mm/sec) WHEN ADJUSTMENT ROLLER IS RELEASED | -2.5 | -1.4 | 0.3 | 1.5 | 2.5 |

+ REPRESENTS REARWARD
- REPRESENTS FRONTWARD

FIG. 9

90

| BELT POSITION | FRONT LARGE | FRONT SMALL | CENTRAL | REAR SMALL | REAR LARGE |
|---|---|---|---|---|---|
| STEERING AMOUNT WHEN ADJUSTMENT ROLLER IS PRESSED | 1.0° | 0.375° | -0.154° | -0.538° | -0.923° |
| STEERING AMOUNT WHEN ADJUSTMENT ROLLER IS RELEASED | 1.50° | 0.583° | 0.176° | -0.765° | -1.545° |

+ REPRESENTS INCLINATION DIRECTION MOVING REARWARD

- REPRESENTS INCLINATION DIRECTION MOVING FRONTWARD

FIG. 10

WHEN ROLLER IS PRESSED

WHEN $Y < -1.1$, $Y = -0.1 + X \longrightarrow X = Y + 0.1$ ... (1)

WHEN $-1.1 \leq Y < 0.2$, $Y = 0.2 + 1.3X \longrightarrow X = (Y - 0.2) \div 1.3$ ... (2)

WHEN $0.2 \leq Y < 1.0$, $Y = 0.2 + 0.8X \longrightarrow X = (Y - 0.2) \div 0.8$ ... (3)

WHEN $1.0 \leq Y$, $Y = 0.2 + X \longrightarrow X = Y - 0.2$ ... (4)

WHEN ROLLER IS RELEASED

WHEN $Y < -1.4$, $Y = -0.3 + 1.1X \longrightarrow X = (Y + 0.3) \div 1.1$ ... (5)

WHEN $-1.4 \leq Y < 0.3$, $Y = 0.3 + 1.7X \longrightarrow X = (Y - 0.3) \div 1.7$ ... (6)

WHEN $0.3 \leq Y < 1.5$, $Y = 0.3 + 1.2X \longrightarrow X = (Y - 0.3) \div 1.2$ ... (7)

WHEN $1.5 \leq Y$, $Y = 0.5 + X \longrightarrow X = Y - 0.5$ ... (8)

IMAGE FORMING APPARATUS HAVING A CONTROL SECTION WHICH CORRECTS DEVIATION OF A BELT

This application is based on Japanese Patent Application No. 2007-335203 filed on Dec. 26, 2007, which is incorporated hereinto by reference.

BACKGROUND OF THE INVENTION

The present invention relates to an image forming apparatus equipped with an endless rotating belt, and in particular, to an image forming apparatus that carries out deviation correction for the rotating belt.

Some of image forming apparatuses employ a wide and endless rotating belt as a pressing device for an image carrier or for transfer and fixing. For example, in an image forming apparatus such as a color copying machine of a tandem type using electrophotographic process, there is arranged an image forming section composed of a photoreceptor drum, a charging device, a scanning optical device and of a developing device for each of yellow (Y), magenta (M), cyan (C) and black (K) colors, and these respective image forming sections are arranged along the endless intermediate transfer belt, whereby, images respectively for Y, M, C and K are superimposed on the rotating intermediate transfer belt, to form a color image.

When meandering or deviation is caused on the belt, out of color registration comes into existence to deteriorate image quality. Therefore, there is controlled to detect the state of deviation of the belt for correction so that the belt may run stably (for example, see Unexamined Japanese Patent Application Publication No. 57-139775).

Deviation correction is carried out by driving, for example, a prescribed mechanism that changes a degree of tension of the belt, with a stepping motor. With respect to control of the stepping motor, a meandering correction table showing relationship between an amount of deviation of the belt and an amount of correction (an amount of control to be given to the stepping motor) is prepared in advance, and the control is carried out by acquiring an amount of control that corresponds to an amount of deviation of the belt detected by the sensor (for example, see Unexamined Japanese Patent Application Publication No. 9-48533).

Control that employs a correction table prepared in advance without updating it is based on the assumption that relationship between an amount of deviation of the belt and an amount of control for correcting the amount of deviation is constant and does not fluctuate. Actually, however, when the belt ages, a relationship between an amount of control and a belt behavior is changed. Therefore, when the belt ages, an amount of control obtained from a correction table becomes an inappropriate value, and if this value is used for control, longer time is required for the belt to become the stable state free from deviating, which is a problem.

SUMMARY OF THE INVENTION

The present invention is to solve the aforesaid problems, and its object is to provide an image forming apparatus capable of correcting deviation of a belt with an appropriate amount of control corresponding to a state of deterioration of the belt.

Aspects of the invention for achieving the aforesaid objective are as follows.

An image forming apparatus has therein a rotating belt that is rotated, a drive section that rotates the belt, a detection section that detects a position of the belt in its lateral direction, a moving section that moves the belt in its lateral direction, a control section to conduct deviation correction to control operations of the moving section and corrects deviation of the belt, and a memory section, and the control section changes an amount of control to be given to the aforesaid moving section under the condition where the belt is rotated to obtain a correction data showing a relation between the aforesaid amount of control and a change of a position of the belt in its lateral direction detected by the aforesaid detection section, and conducts the aforesaid deviation correction based on the aforesaid correction data stored in the memory section after conducting preparatory actions stored in the memory section.

In the aforesaid aspects, steering control is carried out by using a correction table prepared based on an actual measurement value of a relationship between an amount of control to be given to a moving section and a change in a position of the belt in its lateral direction. Therefore, it is possible to control with an appropriate amount of control conforming to the actual behavior of the belt.

BRIEF DESCRIPTION OF THE DRAWINGS

FIG. 5 is an illustration showing an example of deviation correction speed table.

FIG. 7 is an illustration showing an example of a table of detected values.

FIG. 9 is an illustration showing an example of a correction table.

FIG. 10 is an illustration showing a conversion expression.

DETAILED DESCRIPTION OF THE PREFERRED EMBODIMENT

Figure 1:
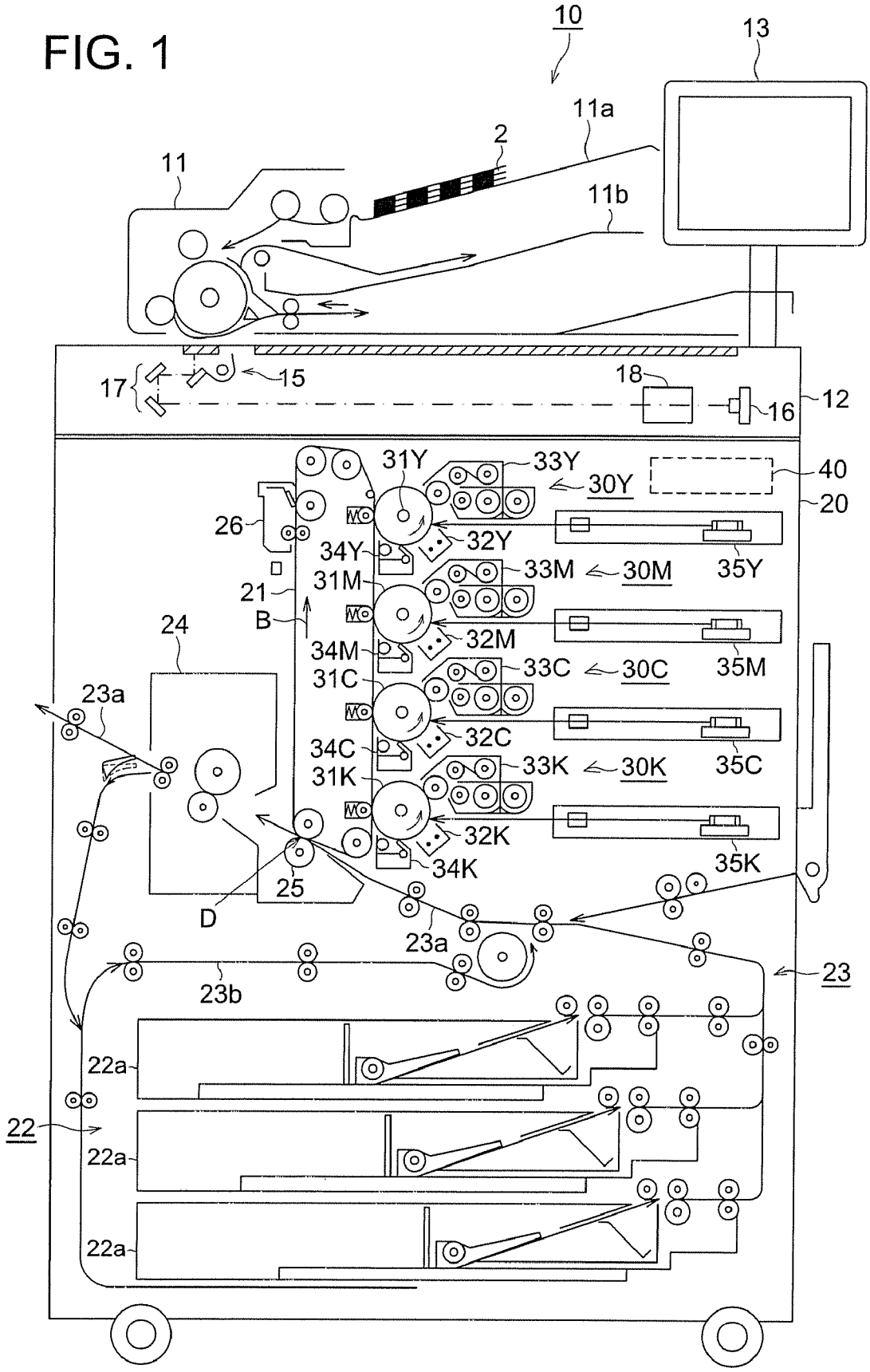
FIG. 1 is an illustration showing a sectional structure of an image forming apparatus relating to the embodiment of the invention.

An embodiment of the invention will be explained as follows, referring to the drawings.

Figure 2:
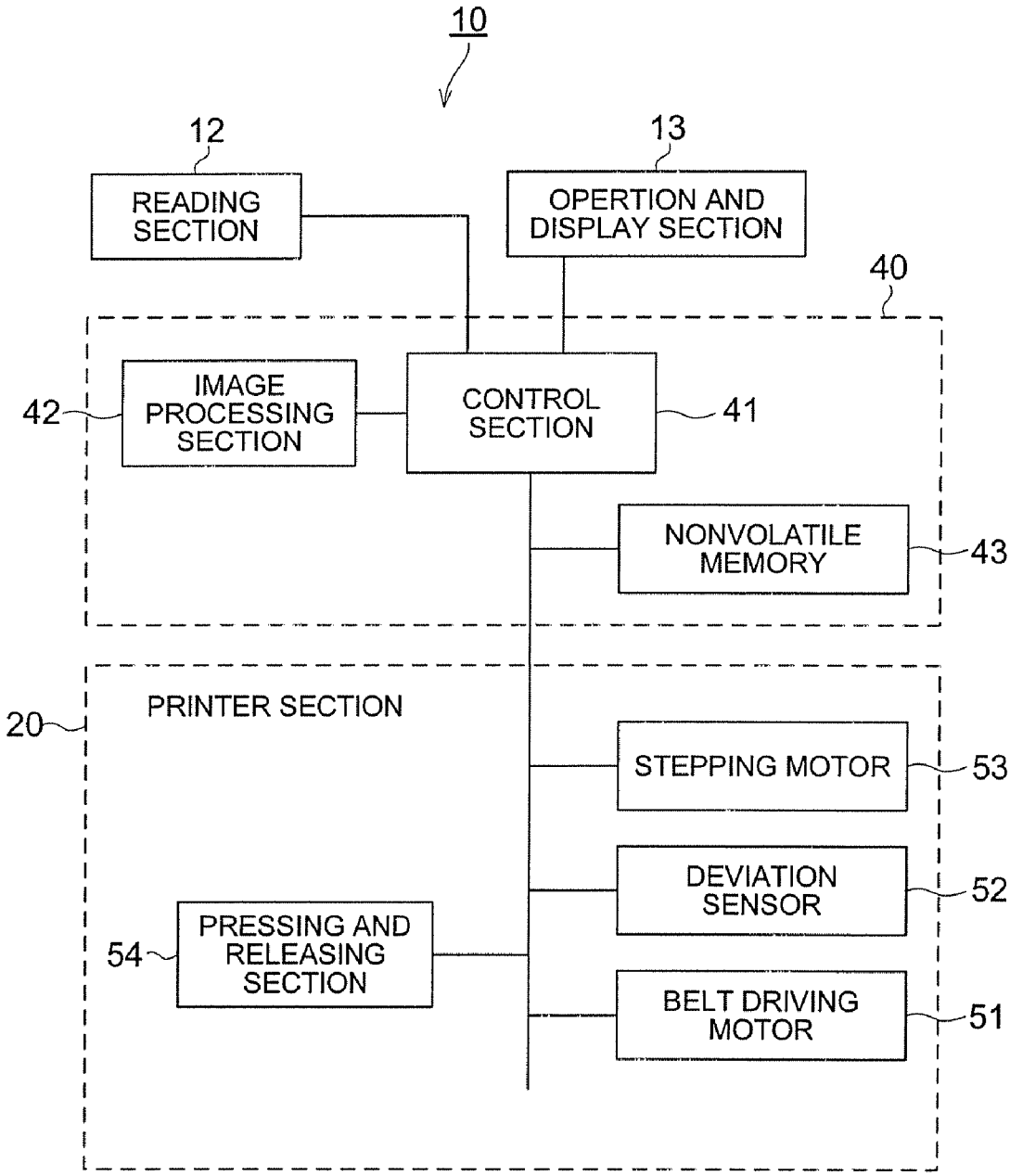
FIG. 2 is a block diagram showing an electrical schematic structure of an image forming apparatus relating to the embodiment of the invention.

FIG. 1 shows a sectional structure of image forming apparatus 10 relating to the embodiment of the invention, and FIG. 2 shows an electrical schematic structure of image forming apparatus 10. The image forming apparatus 10 is an apparatus called a color digital copying machine, and it is composed of reading section 12 equipped with automatic document feeder 11, operation and display section 13, printer section 20 and of circuit board unit 40.

Automatic document feeder 11 (see FIG. 1) carries out functions to feed documents 2 stacked on document placement tray 11*a* to a reading position of reading section 12 one sheet by one sheet and to eject documents which have been read to ejection tray 11*b*.

Reading section 12 has a function to read a document in color. The reading section 12 is equipped with exposure and scanning section 15 that is composed of a light source and a mirror, line image sensor 16 for color that receives reflected light coming from a document and outputs electric signals corresponding to light intensity of the aforesaid reflected light for respective colors, various types of mirrors 17 which introduce reflected light coming from a document to the line image sensor 16 and with collective lens 18.

Printer section 20 is an image forming apparatus of a tandem type which is equipped with intermediate transfer belt 21 representing an endless belt that is wider than a transfer sheet, plural image forming sections 30Y, 30M, 30C and 30K each forming an image in a single color on the intermediate transfer belt 21, sheet feed section 22 that feeds a transfer sheet, conveyance section 23 that conveys the fed transfer sheet and with fixing device 24.

The image forming section 30Y forms an image in yellow (Y) color on the intermediate transfer belt 21, the image forming section 30M forms an image in magenta (M) color on the intermediate transfer belt 21, the image forming section 30C forms an image in cyan (C) color on the intermediate transfer belt 21, and the image forming section 30K forms an image in black (K) color on the intermediate transfer belt 21.

The image forming section 30Y has photoreceptor 31Y representing a cylindrical electrostatic latent image carrier on which an electrostatic latent image is formed, and has charging device 32Y, developing device 33Y, and cleaning device 34Y which are arranged around the photoreceptor. Further, the image forming section 30Y is equipped with a laser diode that is turned on and turned off according to image data, a polygon mirror and with writing unit 35Y that is composed of various types of lenses and mirrors.

The photoreceptor 31Y is driven by an unillustrated drive section to rotate in the fixed direction (direction of arrow A in the figure), and the charging device 32 charges the photoreceptor 31 evenly. The writing unit 35Y carries out a function to scan repeatedly a surface of the cylindrical photoreceptor 31Y in its axial direction (main scanning direction) with a laser beam, by reflecting the laser beam emitted from the laser diode with a rotating polygon mirror. When the surface of the photoreceptor 31Y charged evenly is scanned by the laser beam that is turned on and turned off in accordance with image data in yellow color, an electrostatic latent image is formed on the photoreceptor 31Y.

The developing device 33Y visualizes the electrostatic latent image on the photoreceptor 31Y with toner in yellow color. A toner image thus formed on the surface of the photoreceptor 31Y is transferred onto intermediate transfer belt 21 at a position where the toner image comes in contact with the intermediate transfer belt 21. The cleaning device 34Y carries out a function to rub toner particles remaining on the surface of the photoreceptor 31Y after transferring and thereby to remove and collect them.

Each of the image forming sections 30M, 30C and 30K is the same as the image forming section 30Y in terms of constitution, except the points that a color of toner is different each other, and a laser beam is turned on and turned off depending on image data corresponding to respective colors. For this reason, explanations for them will be omitted here. Incidentally, in the figure, an element that is different in terms of color but is the same in terms of constitution in comparison with an element of the image forming section 30Y is given a symbol wherein a figure is the same and a suffix is changed from Y to M, C and K.

The intermediate transfer belt 21 is entrained about plural rollers so that a rotating path may be formed, and it rotates in the direction of arrow B in the drawing while forming images. In the course of rotating, images (toner images) each being in each color are formed to be overlapped on the intermediate transfer belt 21 by image forming sections 30Y, 30M, 30C and 30K, in the order of Yellow (Y), Magenta (M), Cyan (C) and Black (K), thus, a color image is composed. This color image is transferred onto a transfer sheet from the intermediate transfer belt 21 when high voltage is applied on secondary transfer roller 25 at secondary transfer position D. On the downstream side of the secondary transfer position D in the direction of rotation, there is installed belt cleaning device 26 that removes toner remaining on the intermediate transfer belt 21 after transferring.

Sheet feed section 22 has plural sheet feed cassettes 22*a* each housing therein transfer sheets to be used for printing, and carries out a function to feed out transfer sheet one by one from the selected sheet feed cassette 22*a* toward conveyance section 23. Meanwhile, for two-sided printing, the conveyance section 23 is equipped with reversing path 23*b* through which a transfer sheet which has passed through fixing device 24 is reversed inside out, and then, it joins again ordinary path 23*a* at the upstream side of secondary transfer position D, in addition to ordinary path 23*a* through which a transfer sheet fed out of sheet feed cassettes 22*a* is caused to pass through secondary transfer position D and through fixing device 24 to be ejected to an ejection tray positioned outside the apparatus.

Printer section 20 carries out printing by transferring primarily onto respective intermediate transfer belts 21 the images of respective colors formed respectively on photoreceptors 31Y, 31M, 31C and 31K based on image data, then, by transferring images formed on the intermediate transfer belts 21 to be overlapped secondarily onto a transfer sheet by applying high voltage on secondary transfer roller, and by processing the transfer sheet in terms of fixing with fixing device 24.

As shown in FIG. 2, circuit board unit 40 is equipped with control section 41, image processing section 42 that is connected with the control section 41 and with nonvolatile memory 43. The control section 41 carries out a function to control total operations of image forming apparatus 10 and is composed of primary portions such as CPU (Central Processing Unit), ROM (Read Only Memory) that stores programs practiced by CPU, and various types of fixed data, and RAM (Random Access Memory) that serves as a work area when CPU practices programs.

The control section 41 is further connected with reading section 12, operation and display section 13 and printer section 20. The operation and display section 13 carries out a function to accept various types of operations and setting from an operator and a function to display various types of operation image planes, setting image planes and guidance image planes for an operator. The operation and display section 13 is composed of, for example, a liquid crystal display equipped thereon with a touch panel that detects a position of pressing and other switches.

The image processing section 42 performs various types of image processing for image data of respective colors inputted from line image sensor 16 of reading section 12, then, compresses them to store temporarily, and carries out a function to output image data of respective colors of yellow (Y), magenta (M), cyan (C) and black (K) obtained by extending the aforesaid compressed image data to respective image forming sections 30Y, 30M, 30C and 30K of the printer section 20. The nonvolatile memory 43 is a memory that maintains contents of memory even when a power source is turned off, and it serves as a memory section that stores a correction table in which correction data for deviation correction are registered and various types of preset values.

The control section 41 is further connected with belt driving motor 51 representing a driving section to rotate intermediate transfer belt 21, deviation sensor 52 representing a detecting section that detects a position of intermediate transfer belt 21 in its lateral direction, stepping motor 53 serving as a power source for a moving section that moves intermediate transfer belt 21 in its lateral direction and with pressing and releasing section 54 that switches the intermediate transfer belt 21 between the state where the intermediate transfer belt 21 is in pressure contact with photoreceptors 31Y, 31M, 31C and 31K and the state where the pressure contact is released. The pressing and releasing section 54 conducts pressure contact and releasing with a motor that represents power. The control section 41 controls operations of stepping motor 53 of a moving section based on results of the detection by deviation sensor 52 so that meandering and deviating of intermediate transfer belt 21 may be corrected, and thereby, the control section 41 practices deviation correction for the intermediate transfer belt 21.

In addition to the foregoing, the control section 41 is connected with sensors and driving motors relating to sheet feeding section 22, conveyance section 23 and fixing device 24 which are controlled by the control section 41.

Figure 3:
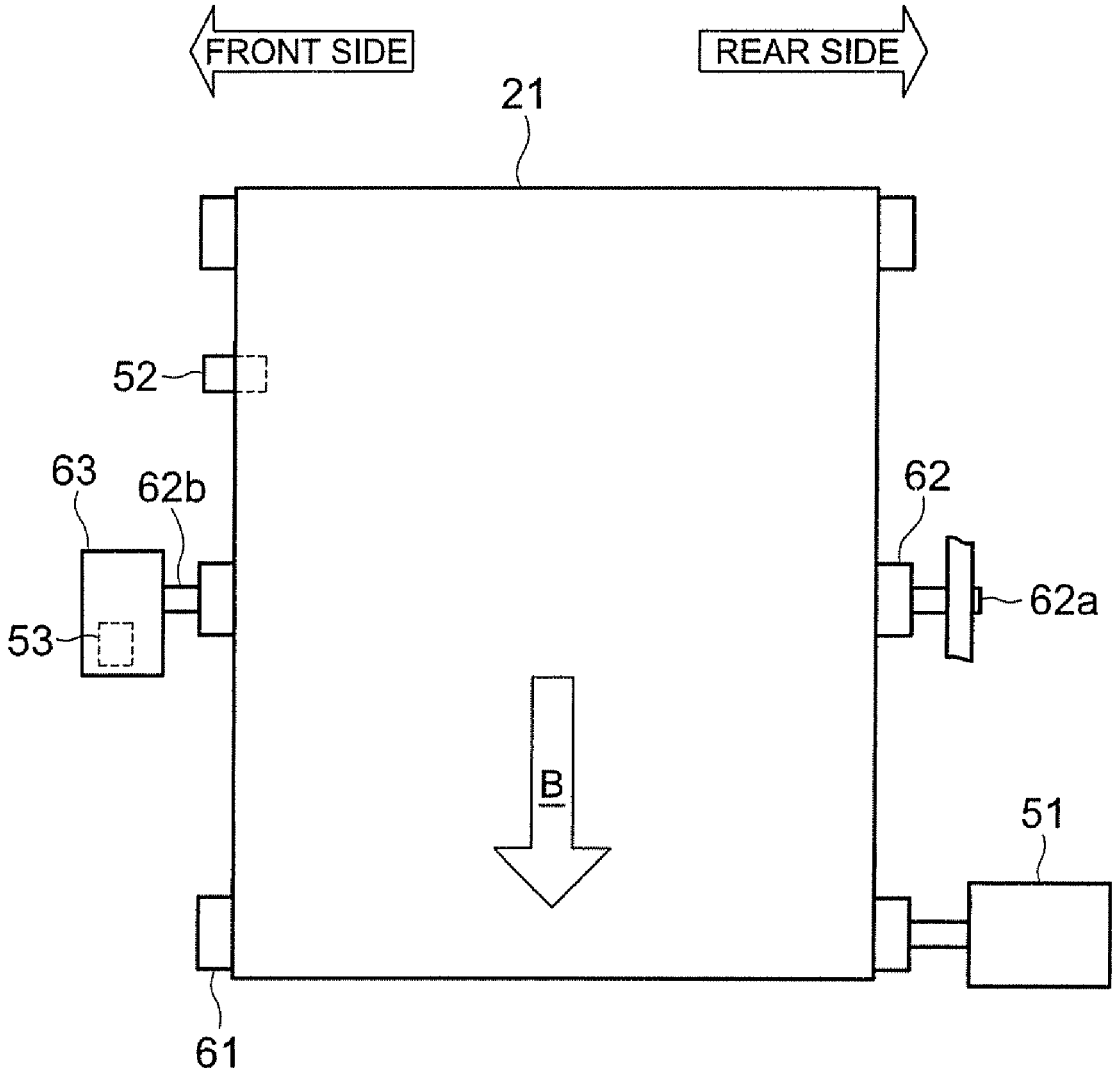
FIG. 3 is an illustration showing schematically a driving mechanism of an intermediate transfer belt.

FIG. 3 shows schematically a driving mechanism for intermediate transfer belt 21. The intermediate transfer belt 21 is entrained about plural cylindrical rollers to form a rotating path (see FIG. 1). The moving section that moves the intermediate transfer belt 21 in its lateral direction is composed of adjustment roller 62 and movable bearing section 63. The adjustment roller 62 is mounted to be capable of changing an inclination of its axis on its one end 62*a*, and the other end 62*b* of the adjustment roller 62 is pivotally supported by movable bearing section 63 composed of a gear and stepping motor 53. By rotating the stepping motor 53 regularly or reversely, it is possible to adjust an angle of the axis of the adjustment roller 62 within a range of ±prescribed angle from the direction that is in parallel with an axis of driving roller 61.

Further, there is provided deviation sensor 52 that detects a position of intermediate transfer belt 21 in the direction in which deviation is caused (lateral direction of intermediate transfer belt 21). An optical sensor that detects a position of an end of intermediate transfer belt 21, for example, is used as deviation sensor 52. In this case, the deviation sensor 52 detects a position of the intermediate transfer belt 21 in five steps including "central", "front small" representing a position of deviating toward this side from "central", "front large" representing a position of deviating toward this side from "front small", "rear small" representing a position of deviating toward rear side from "central" and "rear large" representing a position of deviating toward rear side from "rear small".

Figure 4:
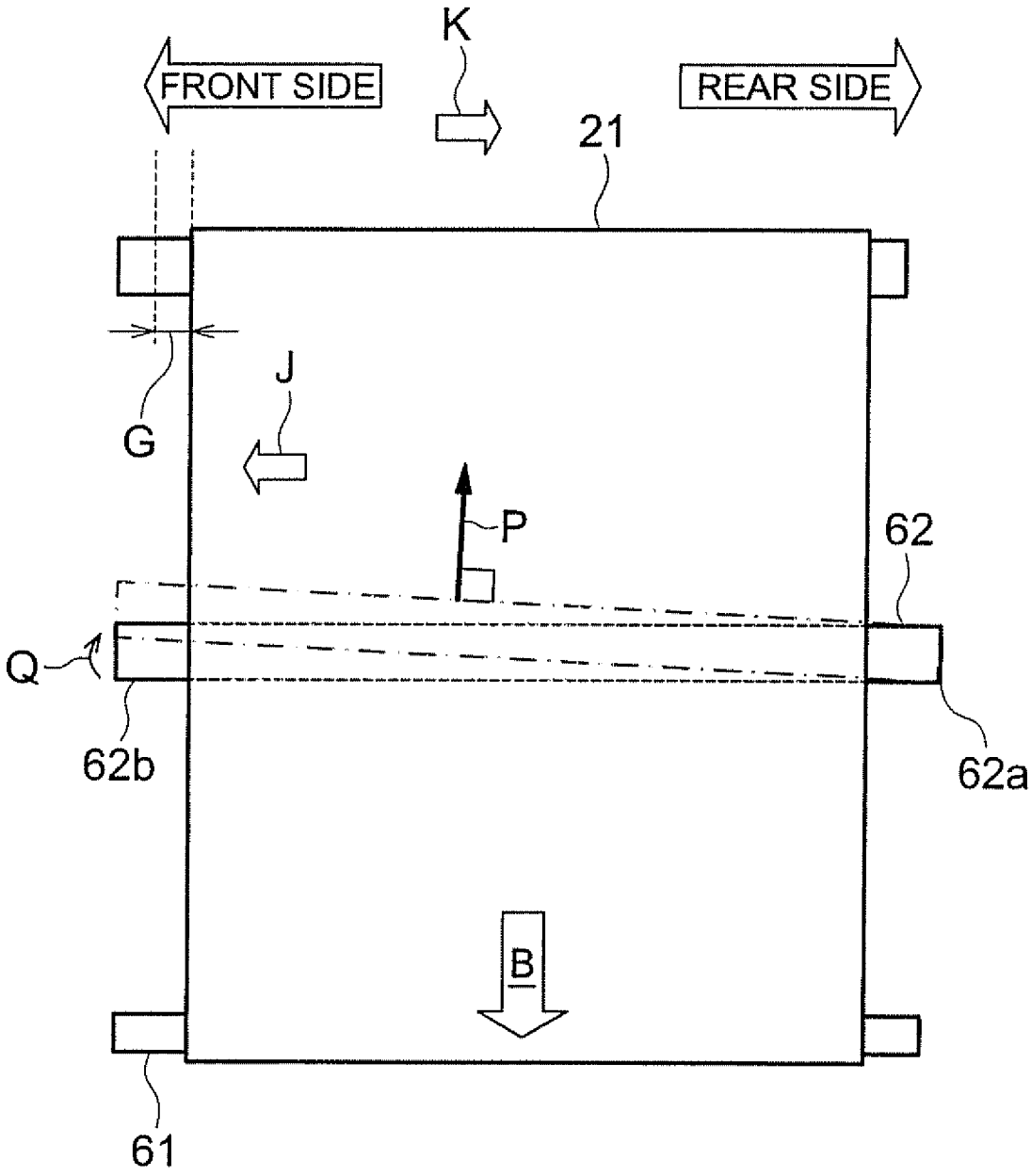
FIG. 4 is an illustration showing an example of correction for deviation correction.

FIG. 4 shows a specific example of deviation correction (which will also be called steering control, from now on) that detects a position of intermediate transfer belt 21 in its lateral direction (state of deviating) to correct the deviation. The steering control is a control wherein, when intermediate transfer belt 21 is deviated in its lateral direction, deviation amount G is detected by deviation sensor 52, and an inclination of adjustment roller 62 is changed by stepping motor 53 so that the intermediate transfer belt 21 may be moved in the direction for correcting the deviation.

For example, in the example shown in FIG. 4, when intermediate transfer belt 21 is deviated in deviating direction J, there is exercised control to change an inclination of adjustment roller 62 so that the intermediate transfer belt 21 may be moved in belt movement direction K that is opposite to the deviating direction J. An angle of inclination of adjustment roller 62 from the direction that is in parallel with driving roller 61 is called steering amount Q. By changing an inclination of adjustment roller 62 as explained above, force in direction P in the drawing is applied to the intermediate transfer belt 21, and an amount of deviation of the intermediate transfer belt 21 is changed. The steering control is exercised constantly during image forming operations (during printing operations).

FIG. 5 shows an example of deviation correction speed table 70 having therein registered relationship between a position of intermediate transfer belt 21 in its lateral direction (state of deviating) and a deviation correction speed in the case of deviation correction for each state of deviating. The deviation correction speed is a movement speed in the case of moving intermediate transfer belt 21 in its lateral direction on the occasion of deviation correction. In the deviation correction speed table 70, there are registered preset values of deviation correction speed for respective positions ("front large", "front small", "central", "rear small" and "rear large") of intermediate transfer belt 21 in the case of pressure contact by pressing and releasing section 54 (pressure contact state for roller) and preset values of deviation correction speed for respective positions ("front large", "front small", "central", "rear small" and "rear large") of intermediate transfer belt 21 in the case of releasing of pressure contact by pressing and releasing section 54 (released pressure contact state for roller). A unit of deviation correction speed is mm/sec, and a positive value shows a movement toward the rear side, while, a negative value shows a movement toward the front side. For example, when intermediate transfer belt 21 is at the position of "front small" under the state of roller pressure contact, it shows that the intermediate transfer belt 21 needs to be moved at the movement speed of 0.5 mm/sec toward the rear side for deviation correction.

Control section 41 detects periodically a position (state of deviating) of intermediate transfer belt 21 in its lateral direction by deviation sensor 52, and exercises steering control by moving the intermediate transfer belt 21 at the deviation correction speed of preset values in deviation correction speed table 70 for the detected position. The deviation correction speed is adjusted by an angle of inclination of adjustment roller 62, and it grows greater when an amount of steering is made to be greater. However, relationship between an amount of steering representing an amount of control for steering control and the deviation correction speed is not fixed, an amount of steering (amount of control) that is needed for realizing a deviation correction speed of preset value for the state of deviating detected by deviation sensor 52 is also fluctuated with change with time, because the intermediate transfer belt 21 changes when it becomes old.

Therefore, before steering control, the control section 41 changes an amount of steering in a wide range under condition of idle running of intermediate transfer belt 21, to measure a movement speed (an amount of movement of intermediate transfer belt 21 in its lateral direction per unit time) of the intermediate transfer belt 21 in each amount of steering, and prepares a correction table in which correction data showing relationship between an amount of steering and a movement speed to carry out preparatory operations stored in nonvolatile memory 43. In the steering control, the control section 41 prepares an amount of steering with which the desired deviation correction speed is obtained, through preparatory operations, and obtains from correction data of correction data stored in nonvolatile memory 43, to conduct deviation correction. Incidentally, preparatory operations do not always need to be carried out each time before practice of steering control, and they are conducted at prescribed timing established in advance.

Figure 6:
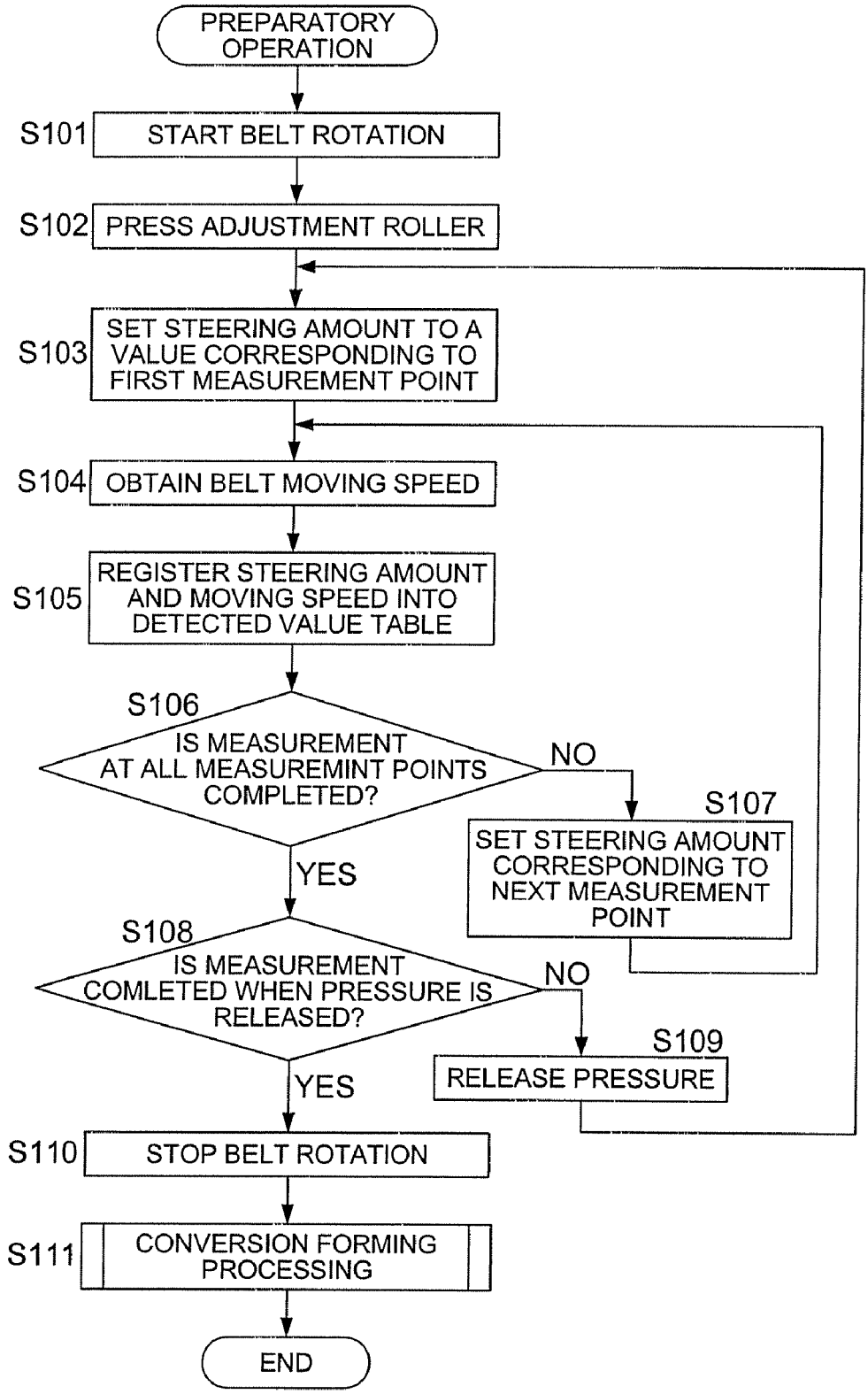
FIG. 6 is a flow chart showing preparatory actions conducted by a control section.

FIG. 6 shows a flow of preparatory operations conducted by control section 41. In the preparatory operations, rotation of intermediate transfer belt 21 is started first (step S101), then, after the rotation is stabilized, the state of roller pressure contact is formed by pressing and releasing section 54 (step S102). Next, an amount of steering is changed in many ways to measure a movement speed of intermediate transfer belt 21 in an amount of steering at each measurement point, and results of them are registered in detected value table 80 shown in FIG. 7. In detailed explanation, an amount of steering is set to the first measurement point representing the first measurement point (step S103), then, a movement speed (including a movement direction) of intermediate transfer belt 21 is derived from values of detection by deviation sensor 52 (step S104), and the derived movement speed is registered on the corresponding place of the detected value table 80 (step S105).

In this case, a movement speed is measured for the first measurement point having a steering amount of −2°, the second measurement point having a steering amount of −1°, the third measurement point having a steering amount of 0°, the fourth measurement point having a steering amount of +1°, and the fifth measurement point having a steering amount of +2°, in the order of the first, second, third, fourth and fifth measurement points. Meanwhile, a unit of movement speed registered in detected value table 80 shown in FIG. 7 is mm/sec, and a positive value shows a movement toward the rear side, while, a negative value shows a movement toward the front side. A period of time for measurement for respective measurement points is longer than a period that is required by intermediate transfer belt 21 to make one turn. Owing to this, it is possible to measure a change of position in the lateral direction and a movement speed more accurately.

In the meantime, with respect to measurement of a movement speed, in the measurement method recommended when measuring a movement speed at the measurement point where an amount of steering is positive, for example, adjustment roller 62 is inclined in its opposite direction to cause intermediate transfer belt 21, then the adjustment roller 62 is changed to the amount of steering at the measurement point, and a movement speed of the intermediate transfer belt 21 in this case is measured.

When measurement is not completed for either one of the aforesaid measurement points under the condition of roller pressure contact (step S106; No), an amount of steering is changed to the next measurement point (step S107), measurement of the movement speed at the amount of steering is conducted (step S104) and registration is carried out (step S105).

When measurement for each of all measurement points is completed under the state of roller pressure contact (step S106; Yes), measurement under the state of releasing of pressure contact is conducted (step S108; No) without stopping. In detailed explanation, pressing and releasing section 54 is controlled to switch to the released state (step S109), and a flow returns to step S103 to conduct measurement for all measurement points in the order from the first measurement point under the released state, and registration of the results in detected value table 80.

When measurement for all measurement points is completed under the released condition (step S108; Yes), rotation of intermediate transfer belt 21 is stopped (step S110), and conversion forming processing to prepare a correction table from detected value table 80 is carried out (step S111) to end the processing.

Figure 8:
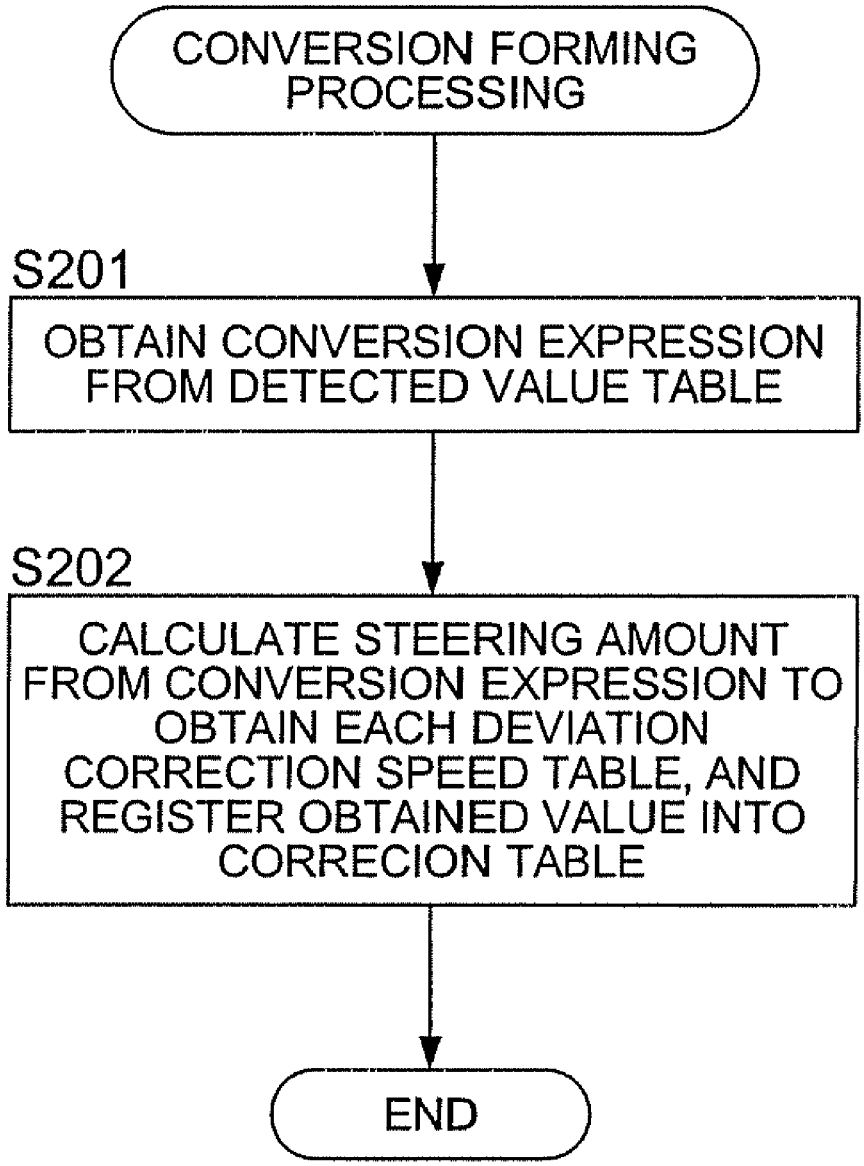
FIG. 8 is a flow chart showing conversion forming processing.

FIG. 8 shows a flow of the conversion forming processing, and FIG. 9 shows an example of correction table 90 prepared through the processing. Control section 41 prepares a conversion expression from respective values registered in detected value table 80 (step S201). Then, an amount of steering for obtaining the deviation correction speed of deviation correction speed table 70 is obtained through calculation from the conversion expression, and its value is registered in correction table 90 (step S202) to terminate the processing.

In this case, when respective values registered in detection value table 80 are plotted, under the roller pressure contact state and under the released pressure contact state, on coordinates on which the horizontal axis represents an amount of steering and the vertical axis represents a movement speed, an expression for a straight line connecting between two adjoining points (for example, movement speed of −2° under the released state, and movement speed of −1° under the released state) is obtained, and a conversion expression representing the aforesaid expression changed in terms of form to an expression for calculating X is obtained. The conversion expression obtained based on detected value table 80 in FIG. 7 is shown in FIG. 10.

A value of X obtained by substituting a value of each deviation correction speed registered in deviation correction speed table 70 for a value of Y of a corresponding conversion expression, for each of the pressure contact state for roller and the released pressure contact state for roller, is obtained as amount of steering X that is needed for realizing deviation correction speed Y.

Correction table 90 in FIG. 9 is of a form of table that corresponds to deviation correction speed table 70 in FIG. 5, and an amount of steering (correction data) for acquiring a preset value of a deviation correction speed registered in each square of the deviation correction speed table 70 is registered in a square at the corresponding position in the correction table 90. A unit of an amount of steering registered in the correction table 90 is an angle (°), and its positive value shows a direction of inclination in which intermediate transfer belt 21 moves toward the rear side, while, its negative value shows a direction of inclination in which intermediate transfer belt 21 moves toward the front side.

For example, a preset value of the deviation correction speed on the occasion wherein intermediate transfer belt 21 is in a position of "front small" under the condition of pressure contact state for roller is "0.5 mm/sec" which is shown in deviation correction speed table 70, and an amount of steering for realizing that deviation correction speed is "0.375°" registered in the corresponding square of the correction table 90.

In the steering control, control section 41 obtains an amount of steering from the correction table 90, by referring to the correction table 90 with parameters including the pressure contact state for roller, or the released pressure contact state for roller, and positions of intermediate transfer belt 21 in its lateral direction detected by deviation sensor 52 ("front large", "front small", "central", "rear small" and "rear large"), and controls stepping motor 53 to secure the aforesaid amount of steering, to conduct deviation correction. In the meantime, data showing corresponding relationship of an amount of steering, the number of steps for driving stepping motor 53 and a direction of driving are stored in ROM or the like, and the control section 41 obtains the number of steps and direction of driving which correspond to the desired amount of steering, based on the aforesaid data.

Figure 11:
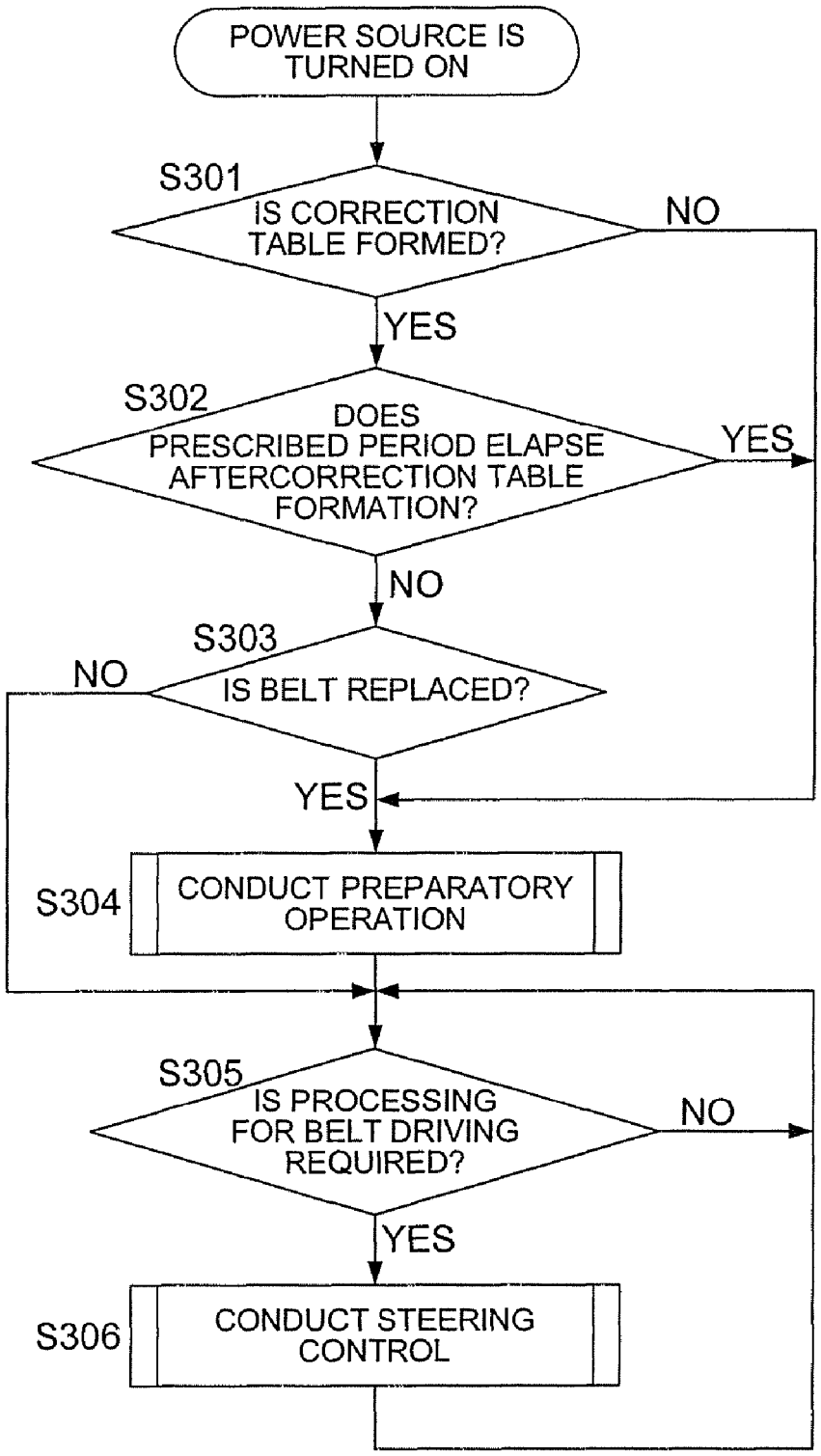
FIG. 11 is a flow chart showing processing conducted by a control section after a power source is turned on, concerning preparatory actions and steering control.

FIG. 11 shows a flow of total operations relating to preparatory operations conducted by control section 41 and to steering control. After image forming apparatus 10 is turned on, the control section 41 investigates whether correction table 90 is prepared and stored in nonvolatile memory 43 or not (step S301), and when the correction table 90 is not prepared (step S301; No), the control section 41 acts so that preparatory operations are carried out, and the correction table 90 is prepared (step S304), to move to step S305.

When the correction table 90 has already been prepared and stored in nonvolatile memory 43 (step S301; Yes), the control section 41 investigates whether the prescribed period has elapsed after the preparation of the correction table 90 or not (step S302). When the prescribed period has elapsed (step S302; Yes), preparatory operations are conducted to update the correction table 90 (step S304) to move to step S305. Incidentally, preset values of the prescribed period are stored in nonvolatile memory 43, so that an operator or a service engineer can change setting freely through a prescribed screen for changing setting displayed on operation and display section 13.

If the prescribed period has not elapsed from the preparation of the correction table 90 (step S302; No), intermediate transfer belt 21 is investigated whether it has been replaced or not (step S303), and when it has been replaced (step S303; Yes), preparatory operations are conducted to update correction table 90 (step S304) and to move to step S305, while, when it has not been replaced (step S303; No), a flow moves to step S305 without conducting preparatory operations. Whether the intermediate transfer belt 21 has been replaced or not is detected by an unillustrated sensor. In the meantime, it is also possible to arrange so that preparatory operations may be conducted when "belt replaced" is inputted from operation and display section 13 through operations of a service engineer after replacement of the intermediate transfer belt 21.

After the correction table 90 is prepared or updated in this way, the control section 41 monitors occurrence of processing that requires driving of intermediate transfer belt 21 for rotation such as practice of a printing job including image forming and practice of correction for doubling (step S305; No). When any processing that requires driving of intermediate transfer belt 21 for rotation occurs (step S305; Yes), the control section 41 starts operations for rotation of intermediate transfer belt 21 and carries out steering control during the period of rotating intermediate transfer belt 21 (step S306). In the steering control, an amount of steering is set based on correction table 90 that is stored in nonvolatile memory 43 as stated above. After completion of the processing relating to the printing job and correction for doubling, the control section 41 stops rotation of the intermediate transfer belt 21, and stops steering control to cause a low to return to step S305.

As stated above, relationship between an amount of steering and a movement speed (behavior) of intermediate transfer belt 21 is actually surveyed by preparatory operations, and correction table 90 is prepared based on the results of the surveying, and an amount of steering in the steering control thereafter is determined, referring to the correction table. Therefore, it is possible to conduct deviation correction according to the actual behavior of the intermediate transfer belt 21, and it is possible to correct deviation with an appropriate amount of correction (amount of steering), even when the intermediate transfer belt 21 varies across the ages. In particular, restoring the deviation with slow behavior having no influence on images during image forming under the state of pressure contact for roller, and restoring the deviation quickly under the state of released pressure contact for roller can be conducted appropriately without being affected by individual difference of equipment and by wear-out rate of the belt.

Further, compared with an occasion wherein preparatory operations are carried out under the state after the start-up of an apparatus when an operator can input a job, an operator is not disturbed in using, and is not troubled, because preparatory operations are conducted during the period when a power source is on. Further, since preparatory operations are carried out each time the prescribed period has elapsed, and correction table 90 is updated, it is possible to update the correction table before an error of an amount of control caused by a variation across the ages grows greater and thereby to maintain an appropriate control constantly, and to lessen the occasions where the start-up takes a long time, compared with an occasion where preparatory operations are conducted each time a power source is turned on. It is further possible to control steering with a correction table corresponding to the behavior of the intermediate transfer belt 21 after replacement, because preparatory operations are conducted even after replacement of the intermediate transfer belt 21.

The embodiment of the invention has been explained as stated above, referring to the drawings. However, the specific structure of the invention is not limited to the embodiment, and variations and addition without departing from the spirit and scope of the invention are also included in the invention.

In the embodiment, the conversion expression approximating with a straight line connecting two points is used. However, another method can also be employed for obtaining, from the measured value, an amount of steering corresponding to the desired deviation correction speed. For example, it is also possible to obtain a regression approximated curve from values of respective measurement points, and thereby to convert the deviation correction speed into an amount of steering by the regression approximated curve.

Further, a form of correction table 90 is not limited to one illustrated in the embodiment. For example, a table wherein an amount of steering corresponding to each deviation correction speed registered in deviation correction speed table 70 is registered is acceptable. In addition, it is also possible to employ an arrangement wherein detected value table 80 or a conversion expression is prepared in preparatory operations to be stored in nonvolatile memory 43, and an amount of steering corresponding to the desired deviation correction speed is calculated from the detected value table 80 or the conversion expression, when conducting steering control.

Timing for practicing preparatory operations is not limited to time illustrated in the embodiment, and for example, when environmental conditions such as humidity and temperature in the inside and outside of the apparatus are changed to exceed tolerance, the preparatory operations may also be practiced when a paper jam is solved. It is further possible to arrange so that timing for practicing preparatory operations can be set and changed freely through a prescribed image plane for setting and changing displayed on operation and display section 13. Further, measurement points for preparatory operations are not limited to those illustrated, and for example, they may also be established more minutely.

In addition, a method to detect a position of intermediate transfer belt 21 in its lateral direction and a structure of a moving section that moves the intermediate transfer belt 21 in its lateral direction are not limited to those illustrated in the embodiment, and an optional one is acceptable provided that the optional one carries out the same function. For example, an arrangement and a type of deviation sensor 52 may be varied appropriately.

Though an occasion wherein intermediate transfer belt 21 is an object to be controlled was explained in the embodiment, belts of other types may also be acceptable provided that each of the belts is controlled in terms of steering for correction of meandering and deviating. For example, acceptable belts include a belt on which an image is formed as in the intermediate transfer belt 21 and a belt that is brought into contact with a transfer sheet or is pressed against a transfer sheet, on a part of its rotating path.

In detailed explanation, on the occasion having a structure wherein a role to press a transfer sheet against intermediate transfer belt 21 from the back side when transferring a color image formed on the intermediate transfer belt 21 onto the transfer sheet is conducted by a rotating endless belt (secondary transfer belt), this secondary transfer belt may be an object to be controlled. Further, on the occasion having a structure wherein a transfer sheet is pressed by a fixing belt of a rotating wide endless belt in the progress to fix toner images by heating a transfer sheet while applying pressure, this fixing belt may be an object to be controlled. In the case of the fixing belt, it is desirable that preparatory operations are carried out under the condition of the fixing temperature.

Though all controls are conducted by control section 41 in the embodiment, it is also possible to control with plural control sections dispersively. Image forming apparatus 10 may also be an apparatus such as a printer and a facsimile machine without being limited to a multifunction peripheral, provided that the apparatus has a function to form an image on a transfer sheet.

In the image forming apparatus relating to the invention, it is possible to practice deviation correction for the belt with an appropriate amount of control corresponding to behavior of the belt, and thereby to stabilize traveling of the belt, even when the belt is deteriorated or is replaced with new one.

What is claimed is:

1. An image forming apparatus comprising:

(a) a rotating belt which rotates around a roller;

(b) a drive section which rotates the belt;

(c) a detection section which detects a position of the belt in a width direction perpendicular to a rotating direction thereof;

(d) a moving section which moves the belt in the width direction;

(e) a pressing and releasing section which brings the rotating belt into contact with an object or releases the rotating belt from contact with the object;

(f) a control section which corrects a deviation of the belt by controlling the moving section; and (g) a memory section which stores a first control value when the rotating belt is kept in contact with the object and a second control value when the rotating belt is released from the object, wherein the control section conducts a preparatory operation in which the control section changes an amount of control to be given to the moving section under the condition where the belt is rotated to obtain a correction data showing a relation between the amount of control and a change of a position of the belt in the width direction detected by the detection section, stores the correction data in the memory section, and then corrects the deviation according to the first control value when the pressing and releasing section brings the rotating belt into contact with the object, and according to the second control value when the pressing and releasing section releases the rotating belt from the object.

2. The image forming apparatus of claim 1, wherein the correction data represents data showing a relation between the amount of control and a moving amount per a unit time of period.

3. The image forming apparatus of claim 1, wherein the control section conducts the preparatory operation when a power source is turned on.

4. The image forming apparatus of claim 1, wherein the control section conducts the preparatory operation when the belt is replaced.

5. The image forming apparatus of claim 1, wherein the control section conducts the preparatory operation at each time when a predetermined period of time elapses.

6. The image forming apparatus of claim 1, wherein the control section measures the change of the position of the belt in the belt width direction with respect to each amount of control for a period of time over one rotation of the belt.

7. The image forming apparatus of claim 1, wherein the belt is a belt on a surface of which an image is formed or a belt in contact with a transfer sheet on which an image is formed.

* * * * *